US005368183A

United States Patent [19]

Singer

[11] Patent Number: 5,368,183

[45] Date of Patent: Nov. 29, 1994

[54] MEAL TRAY SYSTEM

[76] Inventor: Stuart H. Singer, Sugartown Mews Apartments, Apt. 0608, 291 Poplar Ave., Devon, Pa. 19333

[21] Appl. No.: 51,674

[22] Filed: Apr. 23, 1993

[51] Int. Cl.[5] ..... B65D 1/34; B65D 1/36

[52] U.S. Cl. ..... 220/528; 220/408; 220/556; 206/542; 206/541; 206/564; 206/503

[58] Field of Search ..... 206/217, 541, 542, 546, 206/503, 509, 511, 564, 545, 813; 220/408, 528, 556, 555, 17.1, 404, 403, 771; 229/2.5 R

[56] References Cited

U.S. PATENT DOCUMENTS

| | | | |
|---|---|---|---|
| D. 235,498 | 6/1975 | Day | 229/2.5 R |
| 313,218 | 3/1885 | Leslie | 220/555 |
| 1,848,066 | 3/1932 | Shepard et al. | 229/2.5 R |
| 2,094,257 | 9/1937 | Luck et al. | 220/404 |
| 2,262,204 | 11/1941 | Rideout | 220/771 |
| 2,436,097 | 2/1948 | Clarke | 206/541 |
| 3,122,265 | 2/1964 | Innis | 206/541 |
| 3;295,737 | 1/1967 | Page et al. | 229/2.5 R |
| 3,305,124 | 2/1967 | Whiteford | 206/564 |
| 3,532,247 | 10/1970 | Bridges | 206/564 |
| 3,601,277 | 8/1971 | Andrews | 206/564 |
| 3,608,770 | 9/1971 | Naimoli | 206/545 |
| 3,616,943 | 11/1971 | Brink | 206/511 |
| 3,698,594 | 10/1972 | Boehlert | 220/404 |
| 3,847,324 | 11/1974 | Uchanski et al. | 206/813 |
| 3,856,178 | 12/1974 | Norgaard | 206/509 |
| 3,938,688 | 2/1976 | Ryan | 206/541 |
| 4,024,590 | 5/1977 | Wendt | 220/771 |
| 4,478,349 | 10/1984 | Haverland, Jr. et al. | 220/771 |
| 4,892,213 | 1/1990 | Mason, Jr. | 220/771 |
| 5,016,756 | 5/1991 | Wischhusen et al. | 206/546 |
| 5,019,124 | 5/1991 | Flugger | 206/564 |

*Primary Examiner*—David T. Fidei
*Attorney, Agent, or Firm*—Larson & Taylor

[57] ABSTRACT

A food tray is provided which contains food, beverage, napkin and utensil compartments for receiving these items. Food compartment inserts which interlock with the tray and are secured therein are provided. A reusable cup and cold/hot insert(s) which is inserted into and is secured in the cup are provided. A reusable bowl and cold/hot insert(s) which is inserted into and is secured in the bowl are provided. A special food compartment insert which enables the bowl to be held securely in the food compartment and protects the food compartment from soiling is provided. A convenient mechanism of storing and transporting the trays is also provided.

20 Claims, 7 Drawing Sheets

MEAL TRAY SYSTEM

BACKGROUND OF THE INVENTION

The present invention relates to: 1) a tray with separate compartments for holding food items, eating utensils/napkin, and beverage can or cup; 2) a disposable insert for the food compartment of the tray for receiving food items; 3) a reusable beverage cup especially designed for the tray; 4) a disposable insert for the reusable beverage cup; 5) a reusable bowl especially designed for the tray; 6) a disposable insert for the bowl; 7) a special insert for the food compartment of the tray which secures the bowl in the tray.

DESCRIPTION OF THE PRIOR ART

Anyone who has attended an outdoor barbecue or other buffet style meal has experienced the difficulty and frustration that occurs with simultaneously trying to handle a plate full of food, napkin, beverage and eating utensils and, when not seated at a table, with then finding an appropriate, accessible and stable surface on which these items can be placed so that the meal can be eaten.

Numerous types of trays have been proposed for serving meals in service restaurants, airplanes, buses and trains, and for receiving food portions in a compartmentalized tray in which pre-packaged foods, such as frozen dinners, are served.

For example, U.S. Pat. Nos. 3,656,681 and 3,877,603 disclose compartmentalized trays adapted to contain tableware and portions of different, separated foods. In each case, a food-containing tray is adapted for insertion into a recess of a base tray, and is held in place by friction. U.S. Pat. No. 3,305,124 disclosed a compartmentalized tray of relatively rigid plastic and disposable, relatively flexible plastic food receptacles that may be readily removed from the tray. U.S. Pat. No. 3,647,104 is exemplary of a number of known, disposable trays which are formed from thin plastic material to develop a plurality of open compartments adapted to hold, in separate condition, the various food items which are to be served as well as the silverware, cups and dishes, which are to be used with them.

However, these proposed devices do not adequately address or remedy many of the problems encountered with trays for containing and transporting food, napkin, beverage, soup and eating utensils, particularly the awkwardness encountered in using trays, and sliding of the above items, which are contained by such tray both relative to each other and to the tray itself. Nor do these proposed devices address the problem of providing a stable platform for eating from the tray, whether standing, seated at a table or with a tray positioned on one's lap.

SUMMARY OF THE INVENTION

It is, therefore, the principal object of the present invention to provide a meal serving unit or tray which remedies the problems encountered in transporting food, beverage, soup, napkin and eating utensils including the awkwardness and sliding experienced with other trays.

Another object of the invention is to provide a stable platform from which a meal can be eaten, whether standing, seated at a table or with the tray positioned on the lap.

Another object of the invention is to provide handles whose top and bottom surfaces are roughly textured to facilitate secure grasping when holding the tray.

Another object of the invention is to provide a reusable tray, hot/cold beverage cups, and bowl each of which utilizes disposable inserts and virtually eliminates clean-up of these items.

Another object of the invention is to provide the user flexibility in choosing a configuration for the food compartment of the tray that is best suited to the type of food being served, by means of an insert in the food compartment which comes in several different compartmental configurations.

Another object of the invention is to provide inserts for the food compartment of the tray whose edges overlap the compartment, thus preventing food which spills over the top of the insert from slipping into and soiling the interior of the food compartment.

Another object of the invention is to provide a securing mechanism (snap fitting) that prevents the insert for the food compartment of the tray from slipping or falling out of the tray and which further assists in preventing food from slipping into the interior of the food compartment.

Another object of the invention is to provide an insert for the food compartment of the tray which enables the reusable soup bowl of the invention to be held securely in the food compartment, thus preventing the bowl from sliding or tipping over, and which also protects the food compartment from being soiled by spills or other food items being carried in the compartment.

Another object of the invention is to provide a beverage compartment which can hold the reusable beverage cup of the invention, or some types of other disposable and non-disposable cups, or a beverage can.

Another object of the invention is to provide a means such that the trays can be securely stacked on top of one another without sliding.

Another object of the invention is to provide an anti-slip material on or a roughened texturing to the bottom surface of the tray such that the tray is prevented from sliding when positioned on the lap.

Another object of the invention is to provide a storage-transporter unit for carrying all of the components of the invention (trays, beverage cups, disposable inserts for both trays and cups) as well as napkins, eating utensils, and other items.

These and other objects of the invention are achieved by a single-piece, self-contained meal serving unit or tray having separate compartments for food, beverage container, and napkin/eating utensils and incorporating a one-piece insert provided in different configurations which fits into the food compartment. The different configurations of the insert for the food compartment allow flexibility of choice with respect to the type of food which is being served. Each meal serving unit includes a base having top and bottom faces. In its preferred embodiment, the base has a circular compartment for receiving a container, a rectangular compartment for receiving a napkin and eating utensils, and a rectangular compartment for receiving an insert for holding food items. That insert has vertical walls, the edges of which overlap the food compartment. The base has a snap fitting on its top surface for securing the overlapping edges of the insert, so that the edges of the insert can engage the snap fitting and interlock the insert with the base. These combined features provide for a secure fit of the insert to the base, and prevents slippage of the insert and spillage of food into the food compartment of the base. Additionally provided are a reusable beverage cup, an insert for the reusable beverage cup, a reusable bowl, an insert for the reusable bowl, a special insert for securing the reusable bowl in the food compartment, and a means for storing and transporting the trays, beverage cups, inserts, utensils, and other items.

BRIEF DESCRIPTION OF THE DRAWINGS

FIG. 3(*d*) is a plan view of a preferred embodiment of an insert for the food compartment of the tray for securing the soup bowl of the invention.

FIG. 3(*e*) is a cross-sectional view of the insert of FIG. 3(*d*) taken along the line 3*e*—3*e*.

FIGS. 6(*b*) and 6(*c*) are exploded views of portions of FIG. 6(*a*) identified with the lines of 6*b* and 6*c* respectively, which show cross-sectional views of the segments of the snap fitting on the left and right sides of the food compartment, and the food compartment insert for the tray of the invention, and the engagement of said insert with those segments of the snap fitting.

FIG. 6(*d*) is a plan view that shows only the food compartment of the base and the contiguous vertical projections on the top surface of the base around the perimeter of the compartment, within the interior surfaces of which projections is a contiguous horizontal groove for forming the complete snap fitting.

FIG. 6(*e*) is an exploded view of FIG. 6(*b*) which shows the vertical projection on the top surface of the base that borders the left side of the food compartment and the horizontal groove within the interior surface of that projection which form this segment of the snap fitting. Also shown in this view in dotted line is a representation of the corresponding horizontal extension of the food compartment insert, as it appears after being inserted into the food compartment and following its engagement with the snap fitting.

DETAILED DESCRIPTION

Figure 1:
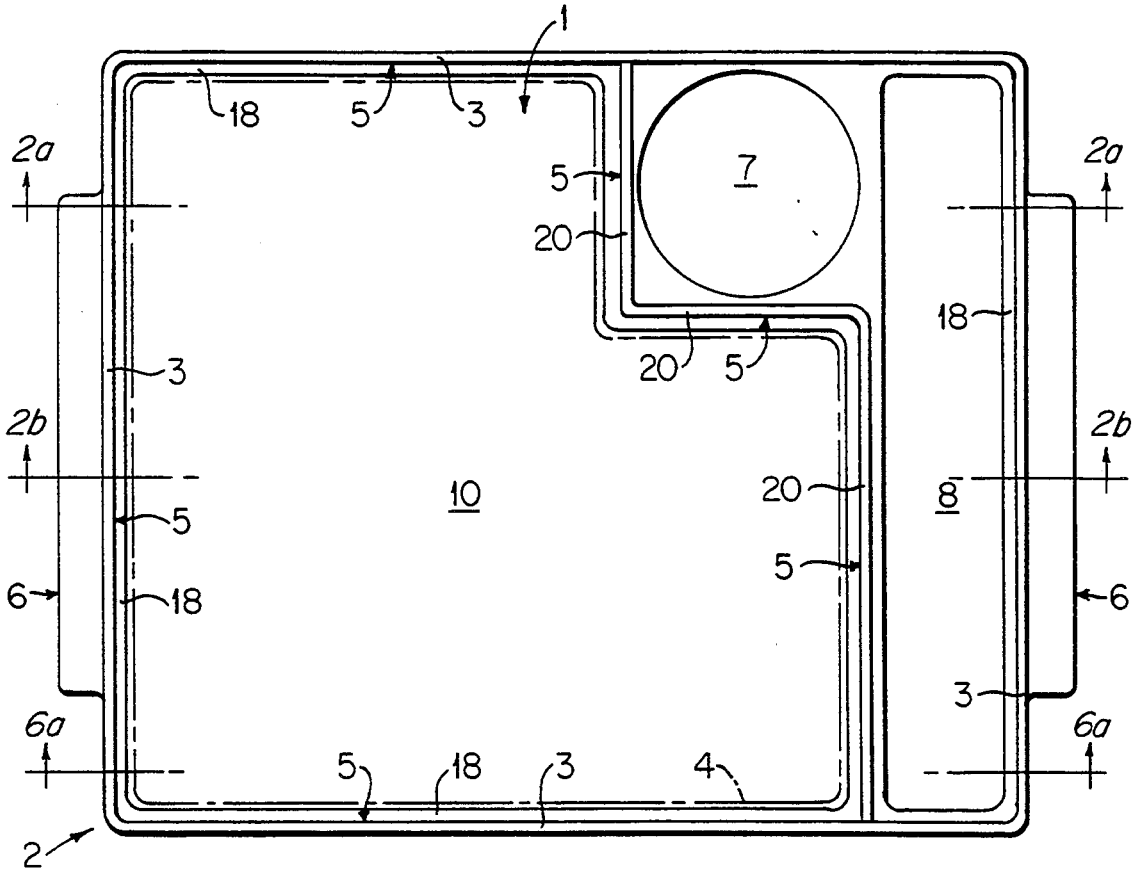
FIG. 1 is a plan view of a preferred embodiment of the tray produced in accordance with the present invention.

FIG. 1 shows the preferred embodiment of tray 1 which is produced in accordance with the present invention.

Figure 2A:
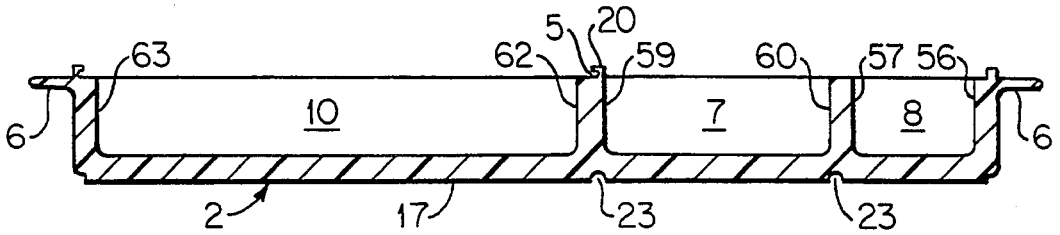
FIGS. 2(*a*) and 2(*b*) are cross-sectional views of the tray of FIG. 1, taken along the lines 2*a*—2*a* and B—B 2*b*—2*b* respectively.
Figure 2B:
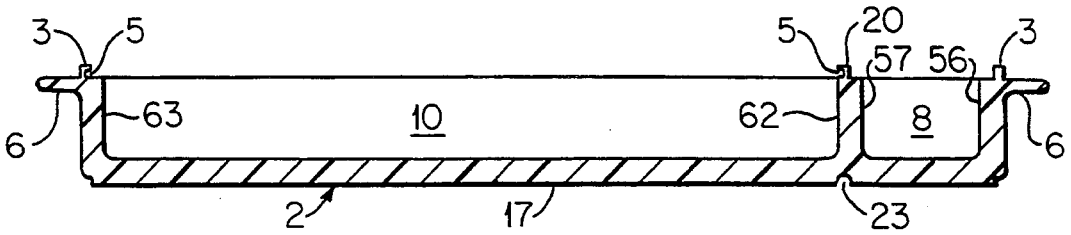
Figure 3A:
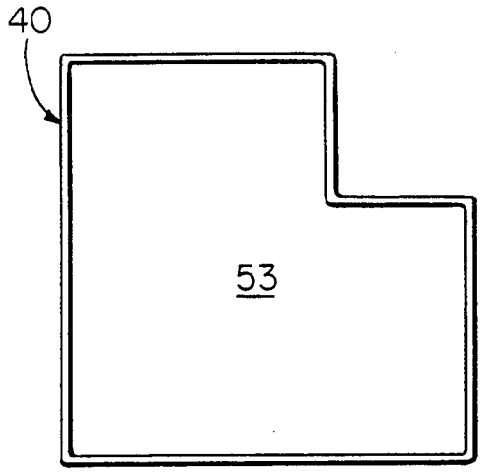
FIGS. 3(*a*), 3(*b*), and 3(*c*) are plan views showing multiple configurations of the preferred embodiment of the insert for the food compartment of the tray.
Figure 3B:
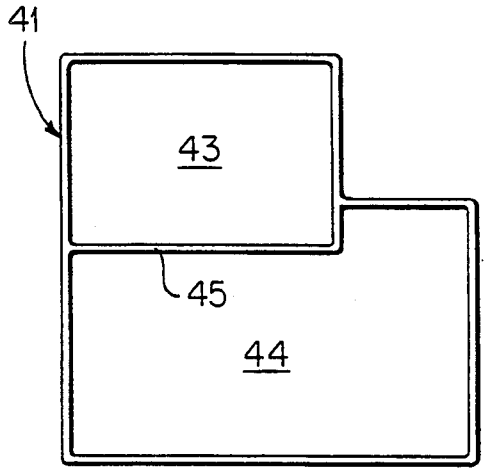
Figure 3C:
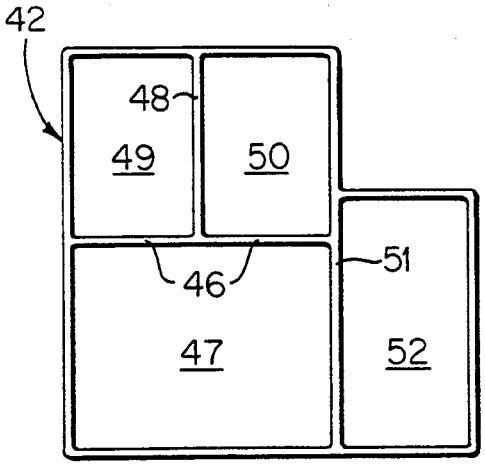
Figure 3D:
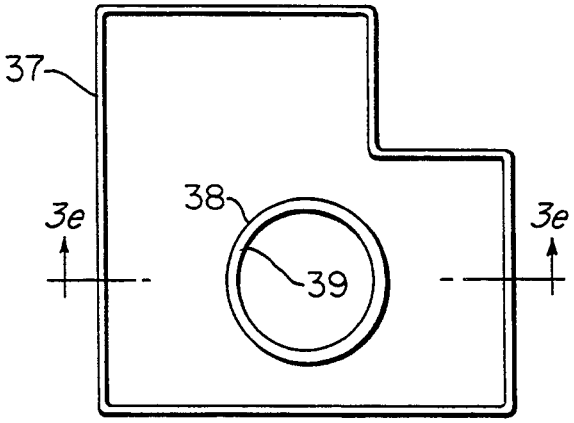
Figure 3E:
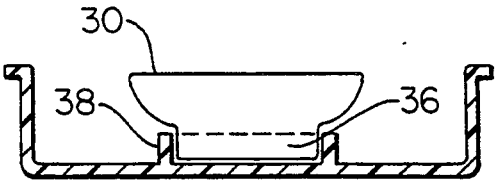

Referring to FIGS. 1, 2(*a*) and 2(*b*), the tray 1 generally comprises a rectangular base 2 having top and bottom faces and multiple vertical projections or walls for forming compartments. The food compartment 10 of the base 2 receives a rectangular insert 4 (shown in chained lines) which is secured to the base by means of a snap fitting positioned on the top surface of the base and which is formed by a contiguous horizontal groove 5 within the vertical projections 3 and 20 that surround the food compartment of the base. Handles 6 are attached to the base 2 to allow for holding or carrying the tray and are roughly textured on their top and bottom surfaces to facilitate secure grasping when holding the tray. The base further having a circular compartment or receptacle 7 for receiving a can or cup for beverages and a rectangular compartment or receptacle 8 for holding napkin and eating utensils.

Figures 6A, 6B, 6C, 6E:
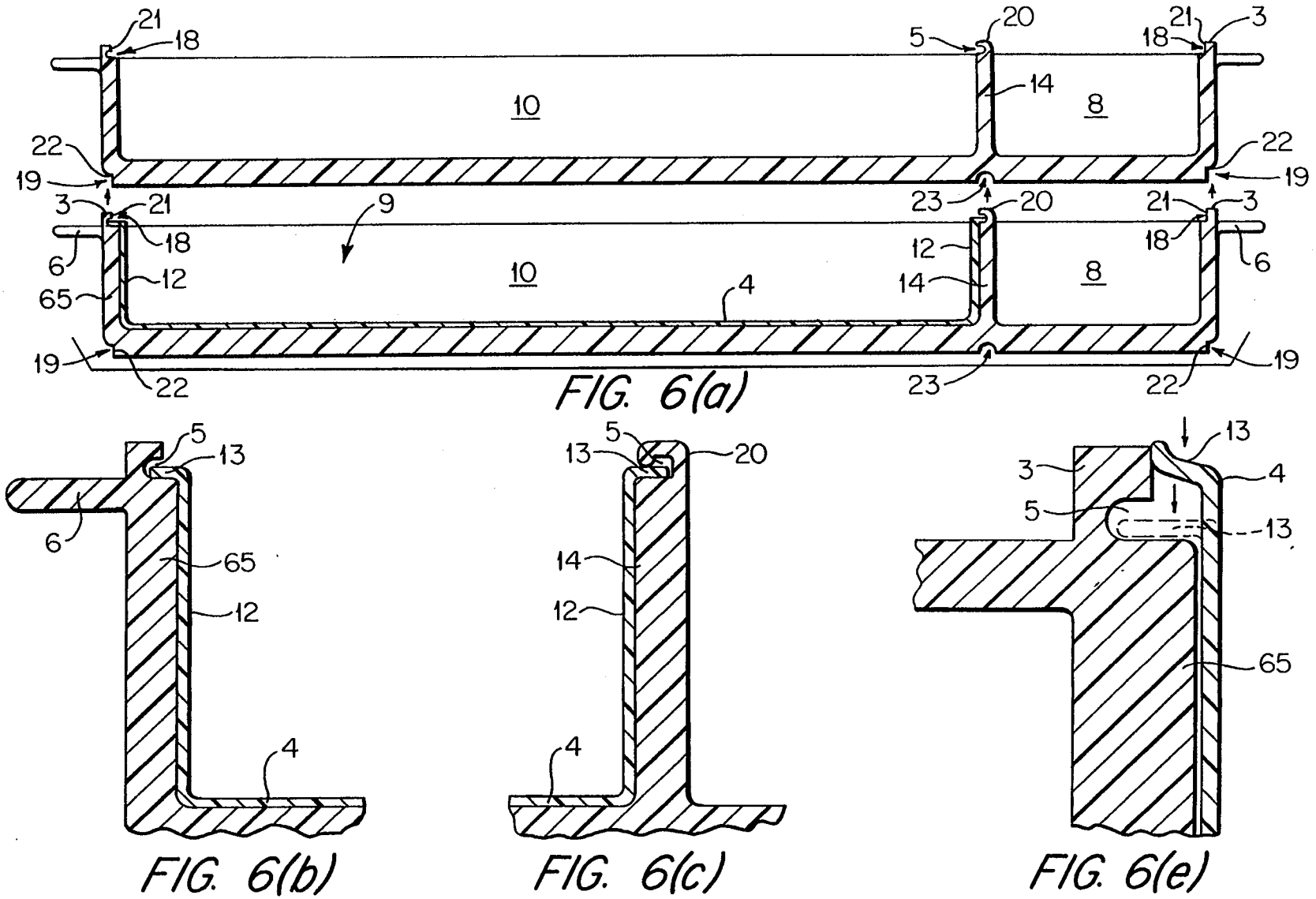
FIG. 6(*a*) is a cross-sectional view of to of the trays of FIG. 1, taken along the line 6*a*—6*a*, showing the features which permit secure stacking of the trays. The lower tray also shows a food compartment insert for the tray of the invention, overlapping the food compartment recess of the base and engaging the snap fitting.
Figure 6D:
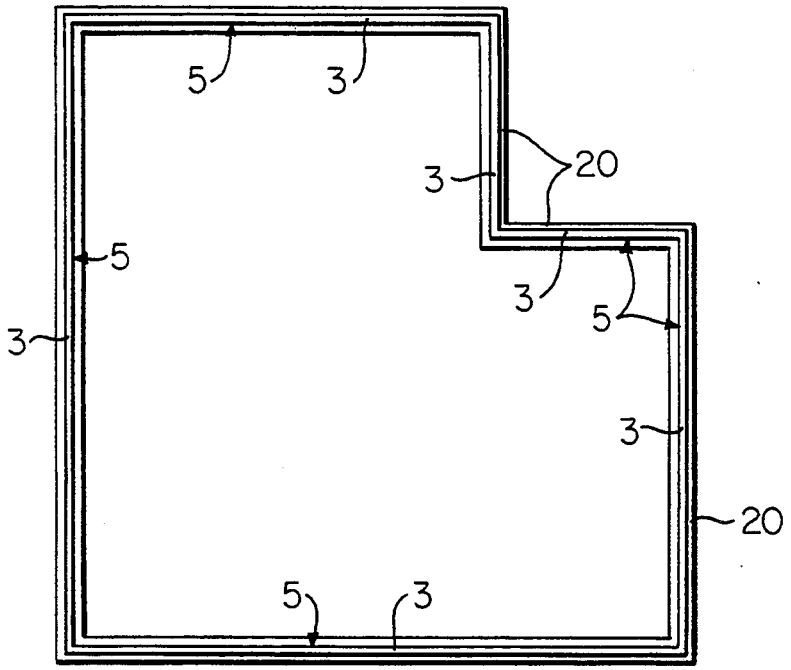

Referring now to FIG. 6(*a*), the tray 1 includes a recess 9 for defining the food compartment 10. Also shown are the rectangular receptacle 8 for holding napkin and utensils and the handles 6. The corresponding preferred embodiment of the insert 4 for the food compartment 10 is received within the recess 9 and is secured in place by means of a snap fitting positioned on the top surface of the tray, which snap fitting is formed by the contiguous horizontal groove 5 within the interior surfaces of the vertical projection 20 and those segments of the vertical circumferential projection 3 which border the food compartment. FIG. 6(*d*) shows only the food compartment 10 of the tray 1 and the vertical projection 20 and the segments of the vertical projection 3, which projections are around the perimeter of the food compartment. FIGS. 6(*b*) and 6(*c*) are exploded views of the vertical walls 65 and 14 of the recess 9 along the lines D—D and E—E respectively in FIG. 6(*a*), showing engagement of the horizontal extensions 13 of the food compartment insert 11 in the snap fitting groove 5. The food compartment insert 11, which is preferably disposable, has vertical walls 12 which overlap the recess 9 and which terminate along horizontal extensions 13 for engaging the snap fitting, by which engagement the insert is secured in the food compartment. Engagement of the food compartment insert 4 is accomplished by pressing the insert downward into the food compartment 10, bringing the horizontal extensions 13 of the insert into contact with the vertical projections 3 and 20 and causing said horizontal extensions 13 to flex upward and retain that position as they slide along the interior surfaces of the vertical projections 3 and 20, until the horizontal extensions 13 reach and insert into the contiguous groove 5 within the interior surfaces of the vertical projections 3 and 20, in which groove 5 they again return to a horizontal position, thus securely interlocking the insert 4 within the food compartment 10 and thus to the tray 1. FIG. 6(*e*) is an exploded view of FIG. 6(*c*) and shows the horizontal extension 13 of the food compartment insert 4 flexing upward as it is being pressed into position to engage the snap fitting and its subsequent return to a horizontal position after insertion within the groove 5. The compartment(s) defined by the food compartment insert 4 preferably taper slightly from top to bottom to allow for engagement of the inserts for convenient packaging and shipping.

Referring now to FIGS. 1 and 6(*a*), an additional feature of the invention is disclosed which enables secure stacking of the tray 1. As shown in FIG. 6(*a*), the bottom 17 of the tray 1 has an indented area around its entire perimeter such that a groove 19 is formed. FIGS. 1 and 6(*a*) show an area 18 on the surface of the tray 1 formed between the respective surface edges of the food, beverage, and utensils compartments and the vertical circumferential projection 3. When stacked, the bottom 17 of one tray sits on the surface 18 of another tray and the inside wall 21 of the vertical circumferential projection 3 of the bottom positioned tray adjoins the vertical wall 22 of the groove 19 of the top positioned tray, thus enabling the trays to be held securely. The contiguous non-linear vertical projection 20 on the top surface of the bottom positioned tray inserts into a contiguous nonlinear groove 23 in the bottom of the top positioned tray. The position, shape, and dimensions of the groove 23 correspond with those of the vertical projection 20, thus enabling the engagement of the vertical projection 20 within the groove 23 and the stable and secure stacking of the trays.

Referring to FIGS. 3(*a*), 3(*b*), and 3(*c*), alternative unitary, single and multi-compartmental inserts 40, 41, and 42 respectively show several different configurations of the preferred embodiment of the disposable food compartment insert for the tray 1. The disclosed inserts 40, 41, and 42 preferably include one-inch deep compartments, thus providing a larger total usable area for food and more effective containment than most available varieties of disposable dinnerware. FIG. 3(*b*) shows a two compartment insert 41 with the top compartment 43 smaller than the bottom compartment 44, as defined by a horizontal division 45 of the insert between the compartments 43 and 44. FIG. 3(*c*) shows a four-compartment insert 42 formed by a horizontal division 46 of the insert to form the main compartment 47, and then a vertical division 48 of the upper compartment to form two equally-sized compartments 49 and 50. A vertical division 51 of the main compartment 47 then forms a fourth compartment 52. FIG. 3(*a*) shows an insert having a single compartment 53.

Figure 4:
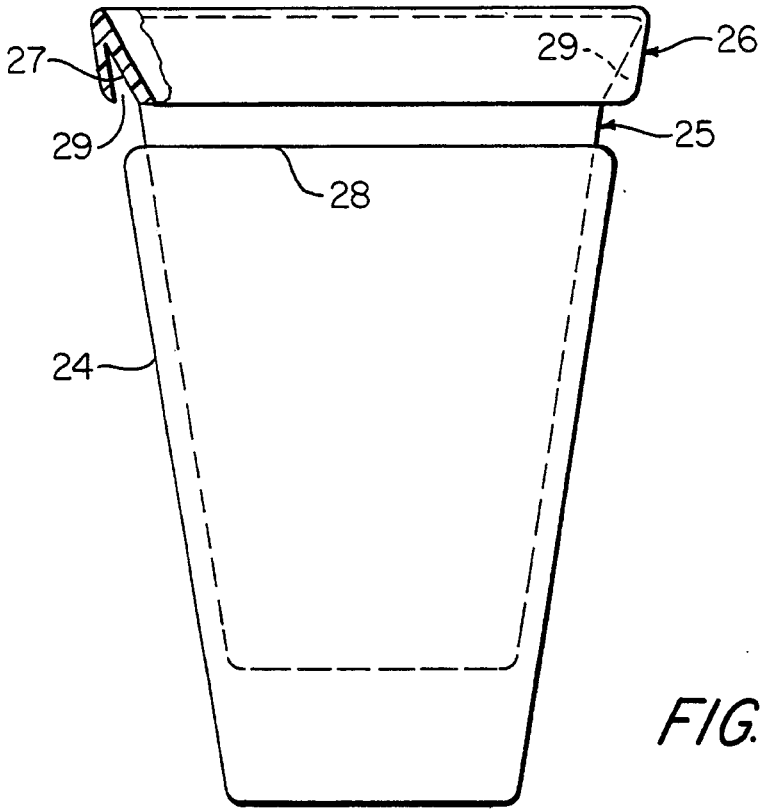
FIG. 4 is an exploded view of the preferred embodiment of the reusable beverage cup of the invention, and the preferred embodiment of the insert for the beverage cup.

As shown in FIG. 4, another feature especially adapted to the present invention is a reusable beverage cup 24. The cup 24 preferably contains a disposable cup insert 25, which has a lip 26 that overlaps the outside surface 27 of the insert. The insert can be made of plastic or any other suitable material. When the insert 25 is placed into the reusable beverage cup 24, the top 28 of the cup 24 is introduced into the circumferential space 29 formed between the inside surface of the lip 26 and the outside surface 27 of the insert that is beneath the lip and the cup and insert are engaged by friction. This engagement prevents the insert 25 from sliding out of the beverage cup 24 when the cup is tilted, as in drinking. To further facilitate such engagement, the outside surface of the cup 24 which engages the insert 25 is roughly textured. In this configuration, both the inside of the reusable beverage cup 24 and the outside surface of the cup which ordinarily would come into contact with the mouth are thus protected from soiling. Further, the overlapping lip 26 and the frictional engagement of the insert 25 with beverage cup 24 also prevent the contents of the beverage cup from spilling over the edge of the insert and into the interior of the beverage cup, as during drinking. The insert(s) for the reusable cup would be capable of holding both hot and/or cold beverages.

Figure 5:
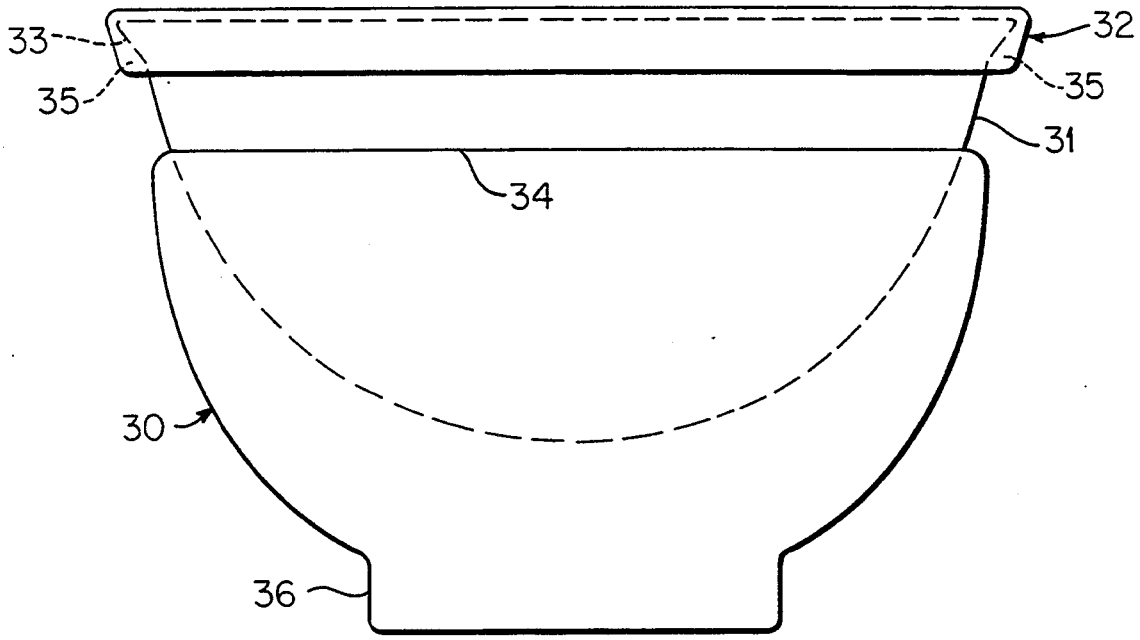
FIG. 5 is an exploded view of the preferred embodiment of the soup bowl of the invention, and the preferred embodiment of the insert for the soup bowl.

As shown in FIG. 5, another feature especially adapted to the present invention is a reusable bowl 30. The bowl 30 preferably contains a disposable bowl insert 31, which has a lip 32 that overlaps the outside surface 33 of the insert. When the insert 31 is placed into the reusable bowl 30, the top 34 of the bowl 30 is introduced into the circumferential space 35 formed between the inside surface of the lip 32 and the outside surface 33 of the insert that is beneath the lip and the bowl and the insert are engaged by friction. This engagement prevents the insert 31 from sliding out of the bowl 30 should the bowl be tilted. To further facilitate such engagement, the outside surface of the bowl 30 which engages the insert 31 is roughly textured. In this configuration, both the inside of the reusable bowl 30 and a portion of the outside surface of the bowl are protected from soiling. Further the overlapping lip 32 and the frictional engagement of the insert 31 with the bowl 30 also prevent the contents of the bowl that spill over the top of the insert from entering into the interior of the bowl. The insert for the reusable bowl would be capable of holding both hot and cold foods.

Reference is now made to FIGS. 1, 3(*d*), 3(*e*), and 5 which show an insert 37 for the food compartment 10 of the tray 1, which is especially designed to secure the reusable bowl 30 in the tray and which prevents the food compartment from being soiled by spills from the bowl and/or other food items being carried in the food compartment. The insert 37 is secured in the food compartment 10 of the tray 1 in the same manner as described previously for the preferred insert 4. The insert 37 has a cylindrical elevation 38 in its center which receives the base 36 of the reusable bowl 30. When the bowl 30 is so inserted, the interior wall 39 of the cylindrical elevation 38 engages by friction the cylindrical vertical wall of the base 36 of the bowl, and the bowl is held securely in the insert 37 and, thus, in the food compartment 10.

FIG. 2(*a*) is a cross-sectional view through the line 2*a*—2*a* which extends through the can or beverage compartment of the tray 1. Also disclosed in this view is a handle 6 and napkin and utensil compartment 8 formed by vertically oriented walls 56 and 57. Can or beverage receptacle 7 is formed by vertically-oriented walls 59 and 60. On the top surface of the vertically-oriented wall 59 is a vertical projection 20, within the interior surface of which is a horizontal groove 5 for forming a segment of the snap fitting. The compartment 10 of the tray 1 which receives the food insert is formed by the vertical walls 62 and 63. A handle 6 is horizontally attached at the top of vertical call 63. FIG. 2(*b*) is a cross-section along the line 2*b*—2*b* through the food compartment of the tray 1. A handle 6 is formed by horizontal projection outward from the top of vertical wall 56. Napkin and utensil compartment 8 is formed by vertical walls 56 and 57. On the top surface of the vertically oriented wall 63 is a vertical projection 3 which extends around the entire perimeter of the tray and within whose interior surface, in those sections which border the food compartment 10, is a segment of the horizontal groove 5 for forming a segment of the snap fitting. A handle 6 is formed by horizontal attachment at the top of vertical wall 63.

To provide stability when positioned on the lap, the bottom of the tray 1 is provided with a suitable means to prevent slipping. For example, it may be roughly textured or have an anti-slip material affixed to it.

The preferred tray also can be produced with both the napkin/utensils compartment and the beverage compartment located on the left side of the tray instead of on the right side.

Figure 9:
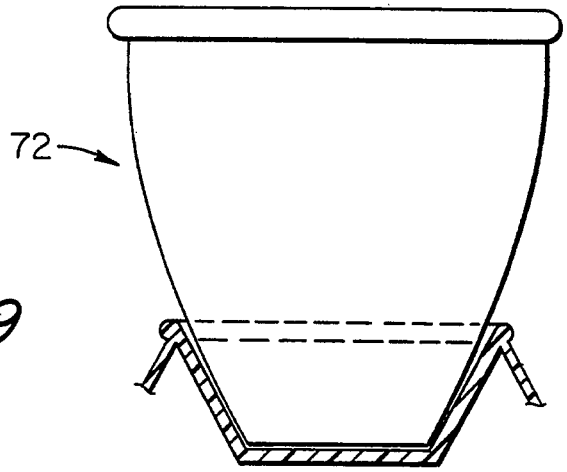
FIG. 9 is an enlarged view of a beverage cup for the holder of the tray of FIG. 7.
Figure 10:
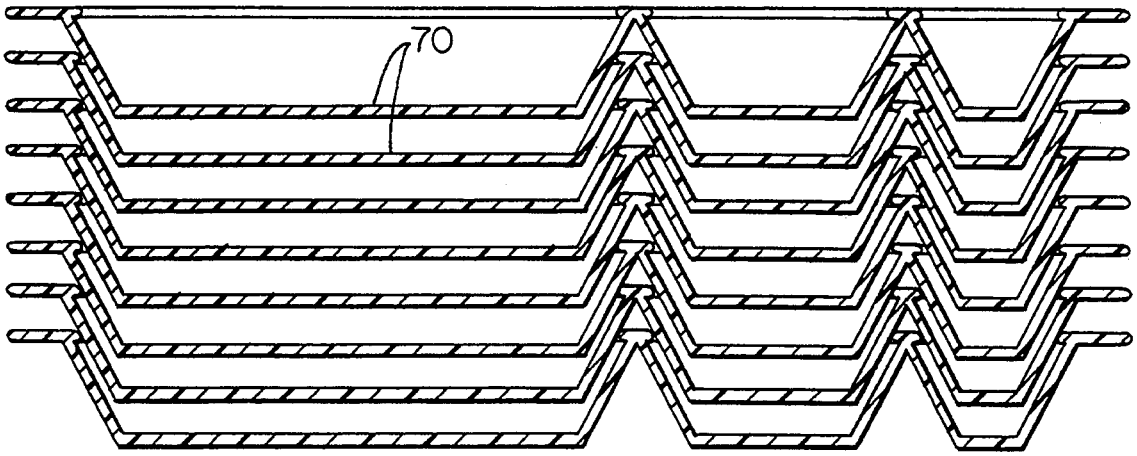
FIG. 10 shows the tray of FIG. 7 in cross-section and its design that allows the tray to be stacked securely.
Figure 7:
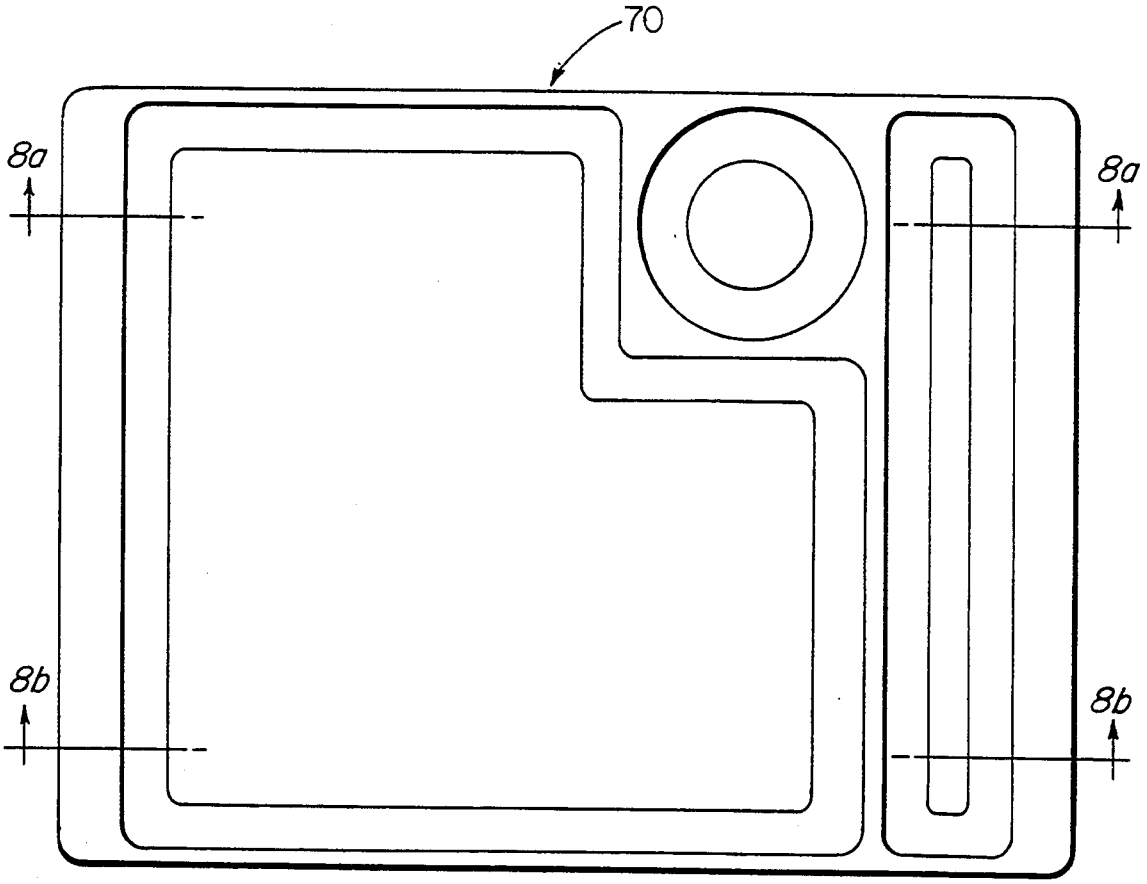
FIG. 7 is a plan view showing another embodiment of the tray.
Figure 8A:
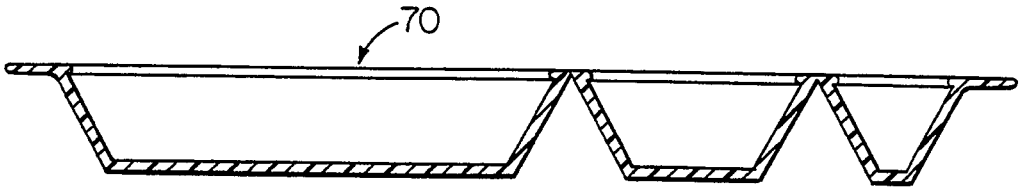
FIGS. 8(*a*) and 8(*b*) are cross-sectional views of the tray of FIG. 7 taken along the lines 8*a*—8*a* and 8*b*—8*b* respectively.
Figure 8B:
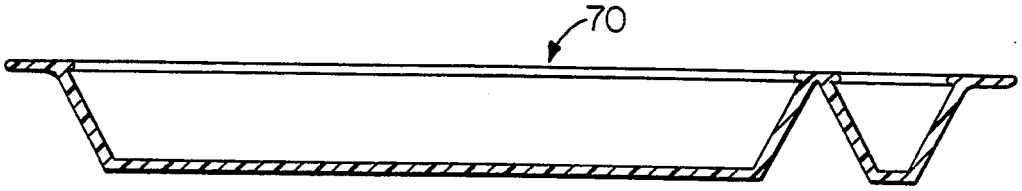
Figure 11:
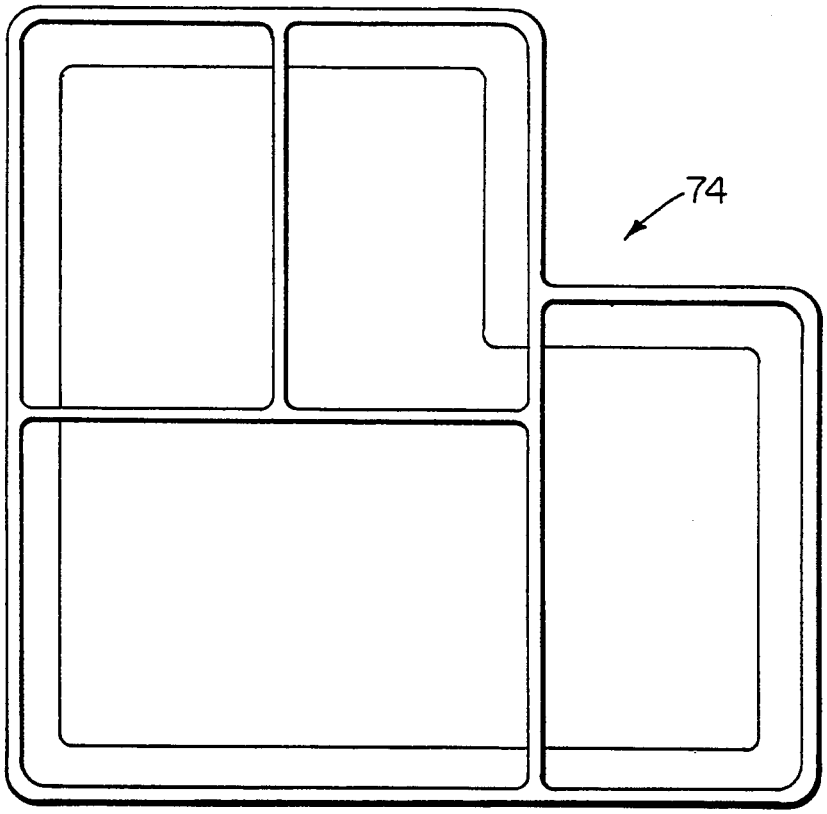
FIG. 11 is a plan view of a food compartment insert for the tray of FIG. 7.

The tray also could be produced such that the vertical walls of its compartments are angled and not perpendicular to their respective floors and the bottom of the tray is contoured rather than a flat surface. Such a tray 70 is shown in FIGS. 7, 8(*a*), and 8(*b*). FIGS. 9 and 11 show the designs of a reusable cup 72 and one configuration of a disposable tray insert 74, respectively, that would be used with such a tray 70. FIG. 10 shows how this tray 70 would be stacked.

Figure 12:
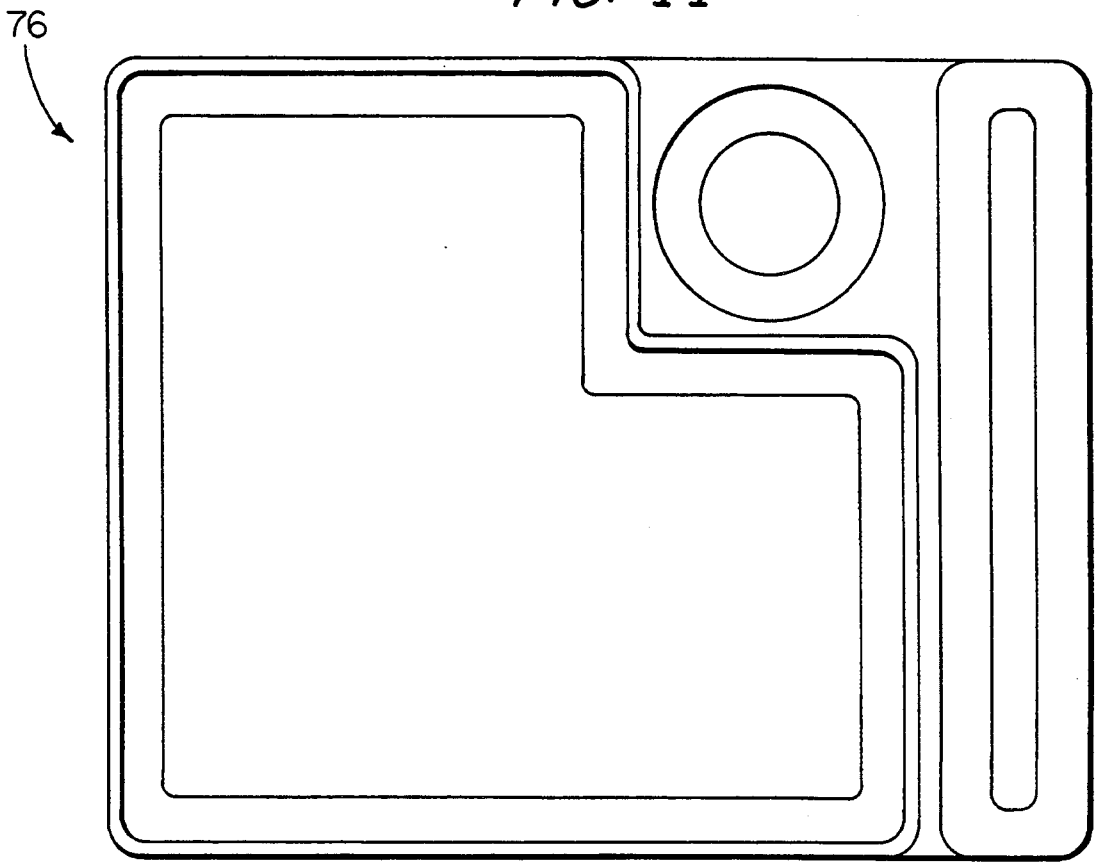
FIG. 12 is a plan view of another embodiment of a one-piece food compartment insert for the preferred tray, having compartments that fit into all (food, beverage, and napkin/utensils) the recesses of the tray.

In the preferred embodiment of the food compartment insert for the preferred tray, the insert fits only into the food compartment recess of the tray. FIG. 12 shows another embodiment of an insert 76 which is a one piece unit having separate compartments that fit into all (food, beverage, napkin/utensils) the recesses of the preferred tray. The food compartment in this embodiment of the insert would be available in the same multiple configurations as offered in the preferred embodiment of the insert, including that of the special insert which enables the bowl of the invention to be held securely in the tray. This alternative embodiment of the insert would be secured in the tray utilizing a snap fitting on the tray's top surface similar to that used to secure the preferred embodiment of the insert. The snap fitting in the alternative case, however, would be formed entirely by a contiguous horizontal groove within the interior surface of the circumferential vertical projection on the top face of and which extends around the perimeter of the preferred tray. This other embodiment of the insert also could be adapted to the tray of FIG. 7.

The preferred embodiments of the tray and tray inserts have overall dimensions, for example, of $12\frac{1}{2} \times 9\frac{1}{4} \times 1\frac{1}{4}$ inches and $9\frac{1}{8} \times 8\frac{3}{4} \times 1$ inches, respectively. Another embodiment of the tray and its components would be one which is proportionately smaller than the preferred embodiment, and would be intended for children. Yet another embodiment of the tray and its components would be one that is larger than the preferred embodiment and might be intended for commercial use in restaurants, cafeterias, etc.

In the preferred embodiment of the tray and food compartment inserts, the depth of the compartments is one inch. Another embodiment of the tray and its inserts would have compartments whose depths are either greater than or less than one inch.

Another embodiment of the tray is one that is insulated and has an insulated cover that interlocks with the tray and that would contain, protect, and maintain the temperature of the tray's contents over an extended period of time, for such applications as providing food to patients in hospitals, nursing homes, etc. This embodiment of the tray also would utilize disposable tray inserts, reusable cups and bowls and their corresponding disposable inserts.

In the preferred embodiments of the reusable beverage cup and the reusable bowl, the inserts engage the cup and bowl respectively by friction. In another embodiment, such engagement would be achieved by a snap fitting, wherein at the top of the interior surface of the lip of either insert a circumferential groove would be formed and the rim of either the cup or bowl would terminate in a rounded circumferential horizontal projection which would engage the groove when the insert was pressed into position.

An additional inventive feature which is specially adapted to the tray is a storage-transporter unit, utilized for storing and transporting the trays, cups, and inserts of the invention in convenient fashion. A handle is provided on top of the unit to facilitate carriage.

I claim:

1. A tray assembly for carrying a food item comprising:

a base having a generally planar bottom and at least one vertical wall extending upwardly from said bottom which forms at least a horizontally closed first compartment, said vertical wall surrounding said first compartment and including an uppermost portion that forms at least a portion of a perimeter about said first compartment;

a disposable compartment insert which is received flat in said first compartment to line said first compartment and thus protect said first compartment from food received on said compartment insert, said compartment insert including at least one upright wall which corresponds to and extends adjacent said at least one vertical wall forming said first compartment; and a snap means for securing said compartment insert to said base in said first compartment and for sealing an underlying portion of said first compartment from the food received on said compartment insert, said snap means including at least one extension which snaps into place and overlies an underlying portion of an adjacent vertical wall such that said compartment insert is securely held in said first compartment and food received on said compartment insert is prevented from spilling over said upright walls and into said food compartment by said snap means, wherein said extension projects from said upright wall of said compartment insert around a periphery thereof, and wherein said snap means includes a horizontal groove provided along an interior surface of said uppermost portion of said vertical wall surrounding said first compartment into which said extension projecting from said upright wall of said compartment insert is snap fit.

2. A tray assembly as claimed in claim 1 wherein said upright wall of said compartment insert is inclined inwardly from top to bottom.

3. A tray assembly for carrying a food item comprising:

a base having a generally planar bottom and a plurality of vertical walls extending upwardly from said bottom which form a horizontally closed first compartment and also form a second compartment for another food tray item; and wherein said vertical wall forming said first compartment meet at substantially right angles;

a disposable compartment insert which is received flat in said first compartment to line said first compartment and thus protect said first compartment from food received on said compartment insert, said compartment insert including upright walls which extend adjacent said vertical walls forming said first compartment, and a connected portion which lines said second compartment; and a snap means for securing said compartment insert to said base in said first compartment and for sealing an underlying portion of said first compartment from the food received on said compartment insert, said snap means including extensions which snap into place and overlie an underlying portion of an adjacent vertical wall such that said compartment insert is securely held in said first compartment and food received on said compartment insert is prevented from spilling over said upright walls and into said food compartment by said snap means.

4. A tray assembly as claimed in claim 1 wherein said compartment insert includes at least one interior wall which divides said compartment insert in said first compartment into two separate portions.

5. A tray assembly as claimed in claim 1 wherein said base includes handles extending horizontally on opposite sides thereof.

6. A tray assembly as claimed in claim 5 wherein said handles include top and bottom surfaces which are roughly textured to facilitate grasping by a user.

7. A tray assembly as claimed in claim 1 wherein said bottom of said base adjacent said vertical wall at an outside of said base includes a respective bottom edge which is indented inwardly and said vertical wall at the outside of said base has a top edge which is configured as a lip to be received in said bottom edge of a tray assembly stacked thereabove.

8. A tray assembly as claimed in claim 7 wherein said bottom of said base adjacent said vertical wall at an inside of said tray includes a respective groove which is indented inwardly and said vertical wall at the inside of said base includes a top edge which is configured as a lip to be received in said groove of said bottom of a tray assembly stacked thereabove.

9. A tray assembly as claimed in claim 1 wherein said bottom includes an anti-slipping means for preventing said bottom from sliding easily.

10. A tray assembly for carrying a food item comprising:

a base having a generally planar bottom and a plurality of vertical walls extending upwardly from said bottom which form a first horizontally closed first compartment and also form a horizontally circular compartment;

a disposable compartment insert which is received flat in said first compartment to line said first compartment and thus protect said first compartment from food received on said compartment insert, said compartment insert including upright walls which extend adjacent said vertical walls forming said first compartment, and a connected portion which lines said second compartment;

a snap means for securing said compartment insert to said base in said first compartment, and for sealing an underlying portion of said first compartment from the food received on said compartment insert, said snap means including extensions which snap into place and overlie an underlying portion of an adjacent vertical wall such that said compartment insert is securely held in said first compartment and food received on said compartment insert is prevented from spilling over said upright walls and into said food compartment by said snap means; and a horizontally circular container which is received in said circular compartment, wherein said circular compartment is sized to narrowly receive a bottom portion of said circular container; and wherein said circular container includes a base container having an open top with a surrounding top rim and a container insert for said base container which is folded over at a top thereof to form an internal space underneath an outer lip in which said space said top rim of said base container is received to hold said container insert in said circular container and to protect said top rim from being contaminated.

11. A tray assembly as claimed in claim 10 wherein said space of said container insert is shaped to frictionally receive said top rim of said container to frictionally hold said container insert in said container.

12. A tray assembly as claimed in claim 11 wherein an outside edge of said top rim of said container is rough textured to facilitate the frictional engagement of said top rim with said container insert underneath said lip.

13. A tray assembly as claimed in claim 12 wherein said lip of said container insert extends down past said top rim when said top rim is received in said space in order to prevent contamination of said top rim and an area immediately therebelow.

14. A tray assembly as claimed in claim 10 wherein said circular compartment is cylindrically shaped and wherein said circular container includes a bottom portion which is cylindrically shaped for frictional reception in said circular compartment.

15. A tray assembly as claimed in claim 1 wherein said base has a plurality of vertical walls which also form a second compartment for another food tray item; end wherein said vertical walls forming said first compartment meet at substantially right angles.

16. A tray assembly as claimed in claim 15 wherein said vertical walls of said base also form a horizontally circular compartment; and further including a horizontally circular container which is received in said circular compartment.

17. A tray assembly as claimed in claim 16 wherein said circular compartment is sized to narrowly receive a bottom portion of said circular container; and wherein said circular container includes a base container having an open top with a surrounding top rim and a container insert for said base container which is folded over at a top thereof to form an internal space underneath an outer lip in which said space said top rim of said base container is received to hold said container insert frictionally in said circular container and to protect said top rim from being contaminated.

18. A tray assembly as claimed in claim 17 wherein said bottom of said base adjacent said vertical walls at an outside of said base includes respective bottom edges which are indented inwardly and said vertical walls at the outside of said base have top edges which are configured as lips to be received in said bottom edges of a tray assembly stacked thereabove.

19. A tray assembly as claimed in claim 18 wherein said base includes handles extending horizontally on opposite sides thereof.

20. A tray assembly as claimed in claim 19 wherein said compartment insert includes at least one interior wall which divides said compartment insert in said first compartment into two separate portions.

* * * * *